US009857756B2

(12) United States Patent
Berke et al.

(10) Patent No.: US 9,857,756 B2
(45) Date of Patent: Jan. 2, 2018

(54) FUSER WITH MODULAR POWER INPUT, DEVICE CAPABLE OF PRINTING INCLUDING A FUSER WITH MODULAR POWER INPUT, AND METHOD THEREOF

(71) Applicant: Xerox Corporation, Norwalk, CT (US)

(72) Inventors: David Berke, London (GB); Timothy David Jonathan Spink, Hertfordshire (GB); Philip James Hambridge, Hertfordshire (GB); Colin William Robert Hewitt, Hertfordshire (GB); Veena Kumari Saluja, Herts (GB); Lakshmi Sujatha Yaramsetti, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/883,813

(22) Filed: Oct. 15, 2015

(65) Prior Publication Data

US 2017/0106666 A1 Apr. 20, 2017

(51) Int. Cl.

| | |
|---|---|
| ***G03G 15/00*** | (2006.01) |
| ***G03G 15/20*** | (2006.01) |
| ***B41J 11/00*** | (2006.01) |
| ***H05B 3/00*** | (2006.01) |

(52) U.S. Cl.

CPC ..... *G03G 15/80* (2013.01); *B41J 11/002* (2013.01); *G03G 15/2039* (2013.01); *G03G 15/2078* (2013.01); *H05B 3/0095* (2013.01); *G03G 15/2042* (2013.01)

(58) Field of Classification Search

CPC ..... G03G 15/2039; G03G 15/205; G03G 15/2078; G03G 15/80; B41J 11/002; H05B 1/0227; H05B 1/0241; H05B 3/0066; H05B 3/0095

See application file for complete search history.

(56) References Cited

U.S. PATENT DOCUMENTS

2011/0217094 A1* 9/2011 Hasegawa ..... G03G 15/20 399/329
2012/0199575 A1* 8/2012 Giri ..... H05B 1/0227 219/490
2012/0308252 A1* 12/2012 Shimura ..... G03G 15/2039 399/67

FOREIGN PATENT DOCUMENTS

JP 2000207981 A * 7/2000

OTHER PUBLICATIONS

Machine Translation of JP2000-207981. Jul. 28, 2000.*

* cited by examiner

*Primary Examiner* — Carla Therrien
(74) *Attorney, Agent, or Firm* — Simpson & Simpson, PLLC

(57) ABSTRACT

A fuser assembly for a device capable of printing, including: at least one heater roller; at least one first heater element located within the at least one heater roller; at least one second heater element located within the at least one heater roller; an electrical line; a power input component including a first power input for the at least one first heater element, a second power input for the at least one second heater element and a third power input for the electrical line; a first electrical circuit designed to operate at a first voltage range and including the at least one heater element and the first electrical line; and a second electrical circuit designed to operate at a second voltage ranged, different from the first voltage range and including the first and second heater elements.

22 Claims, 5 Drawing Sheets

FUSER WITH MODULAR POWER INPUT, DEVICE CAPABLE OF PRINTING INCLUDING A FUSER WITH MODULAR POWER INPUT, AND METHOD THEREOF

TECHNICAL FIELD

The present disclosure relates to a fuser for a device, capable of printing, having a modular power input, in particular, a fuser including heater elements designed to operate at one of two selectable voltage levels. The present disclosure also relates to a device, capable of printing, including the fuser described above and a method of using the fuser described above.

BACKGROUND

As is known in the art, fusers are used in printers, such as laser or light-emitting diode printers, to fuse toner onto print media. One type of known fuser uses an electrically powered heater element inside a fuser roller. Power for the fuser constitutes a major portion of the power usage for the printer. Printers are designed to operate on the power source available at the location at which the printer will be used and the heater element must be configured to operate with the available power supply. Two common power sources are nominal 110V at 60 Hz and nominal 220V at 50 Hz. Heater elements for a fuser can only be operated efficiently at one power level due to losses associated with a non-optimal power factor. For example, a fuser designed to operate efficiently at 60 Hz will not operate efficiently at 50 Hz. Further, heater elements designed to operate at 110V cannot operate at 220V as the excessive voltage will damage the heater elements, and heater elements designed to operate at 220V cannot be sufficiently energized by 110V power. Thus, to optimize power efficiency for a printer including electrical heater elements, it is necessary for a printer manufacturer to have on hand and install respective fusers for each anticipated power supply, which increases stocking and manufacturing costs.

SUMMARY

According to aspects illustrated herein, there is provided a fuser assembly for a device capable of printing, including: at least one heater roller; at least one first heater element located within the at least one heater roller; at least one second heater element located within the at least one heater roller; an electrical line; a power input component including a first power input for the at least one first heater element, a second power input for the at least one second heater element and a third power input for the electrical line; a first electrical circuit designed to operate at a first voltage range and including the at least one heater element and the first electrical line; and a second electrical circuit designed to operate at a second voltage ranged, different from the first voltage range and including the first and second heater elements.

According to aspects illustrated herein, there is provided a printhead for a device capable of printing, including a power supply system and a fuser assembly including: at least one heater roller; at least one first heater element configured to operate at a first voltage range and located within the at least one heater roller; at least one second heater element configured to operate at a second voltage range different from the first voltage range and located within the at least one heater roller; an electrical line; and a power input component including a first power input for the at least one first heater element, a second power input for the at least one second heater element and a third power input for the electrical line. When the device is designed to operate at the first voltage range, the first and third power inputs are connected to the electrical power system for the device. When the device is designed to operate at the second voltage range, the first and second power inputs are connected to the electrical power system for the device.

According to aspects illustrated herein, there is provided method of operating a device capable of printing and including a fuser assembly with at least one first and second heater elements located within at least one heater roller for the fuser assembly, the method including: energizing a power supply system for the device at a first or second voltage level; and when energizing the power supply at the first voltage level: energizing, using the power supply system, the at least one first heater element and not the at least one second heater element, rolling a sheet of print media between the at least one heater roller and at least one pressure roller for the fuser assembly and heating, with the at least one heater roller, toner material on the sheet of print media; or when energizing the power supply at the second voltage level: energizing, using the power supply system, the at least one first and second heater elements, rolling a sheet of print media between the at least one heater roller and at least one pressure roller for the fuser assembly and heating, with the at least one heater roller, toner material on the sheet of print media.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Regarding the term "device useful for digital printing", it should be understood that digital printing broadly encompasses creating a printed output using a processor, software, and digital-based image files. It should be further understood that xerography, for example using light-emitting diodes (LEDs), is a form of digital printing.

Furthermore, as used herein, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, a server, one or more personal computers, a standalone scanner, a mobile phone, an MP3 player, audio electronics, video electronics, GPS systems, televisions, recording and/or reproducing media or any other type of consumer or non-consumer analog and/or digital electronics.

Moreover, although any methods, devices or materials similar or equivalent to those described herein can be used in the practice or testing of these embodiments, some embodiments of methods, devices, and materials are now described.

Figure 1:
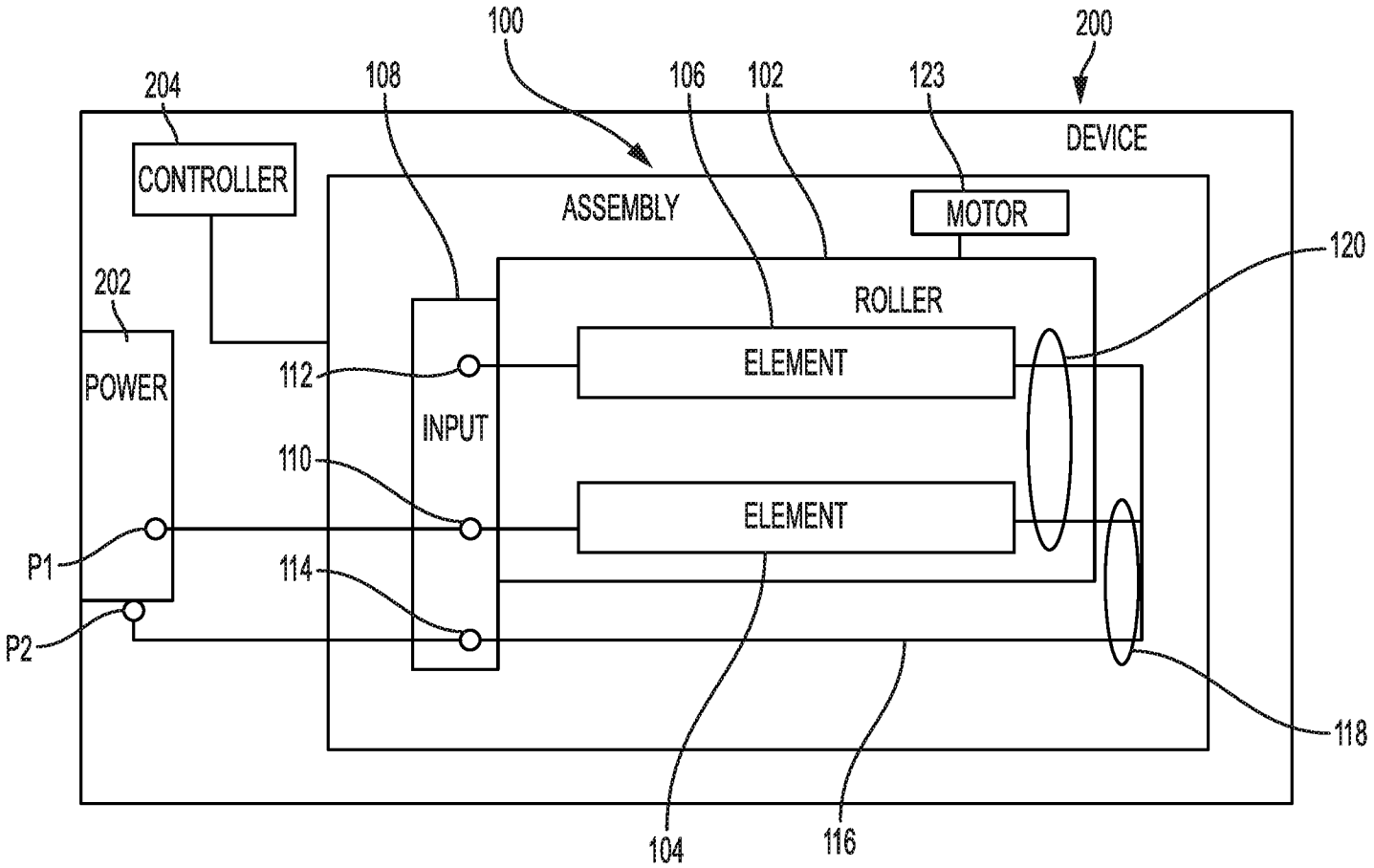
FIG. 1 is a schematic block diagram of an example device capable of printing including a fuser assembly with a modular power input and a single heater roller and single heater elements.

FIG. 1 is a schematic block diagram of an example device capable of printing including a fuser assembly 100 with a modular power input and a single roller and single heater elements. Fuser assembly 100 includes: at least one heater roller 102; at least one heater element 104; at least one heater element 106; and modular power input 108. Heater element (s) 104 and 106 are configured to operate at voltage range V1 and are located within roller(s) 102. Power input component 108 includes: power input 110 for heater element(s) 104; power input 112 for heater element(s) 106; and power input 114 for electrical line 116. In the example of FIG. 1, assembly 100 includes only a single roller 102, only a single heater element 104 and only a single heater element 106.

Figure 2:
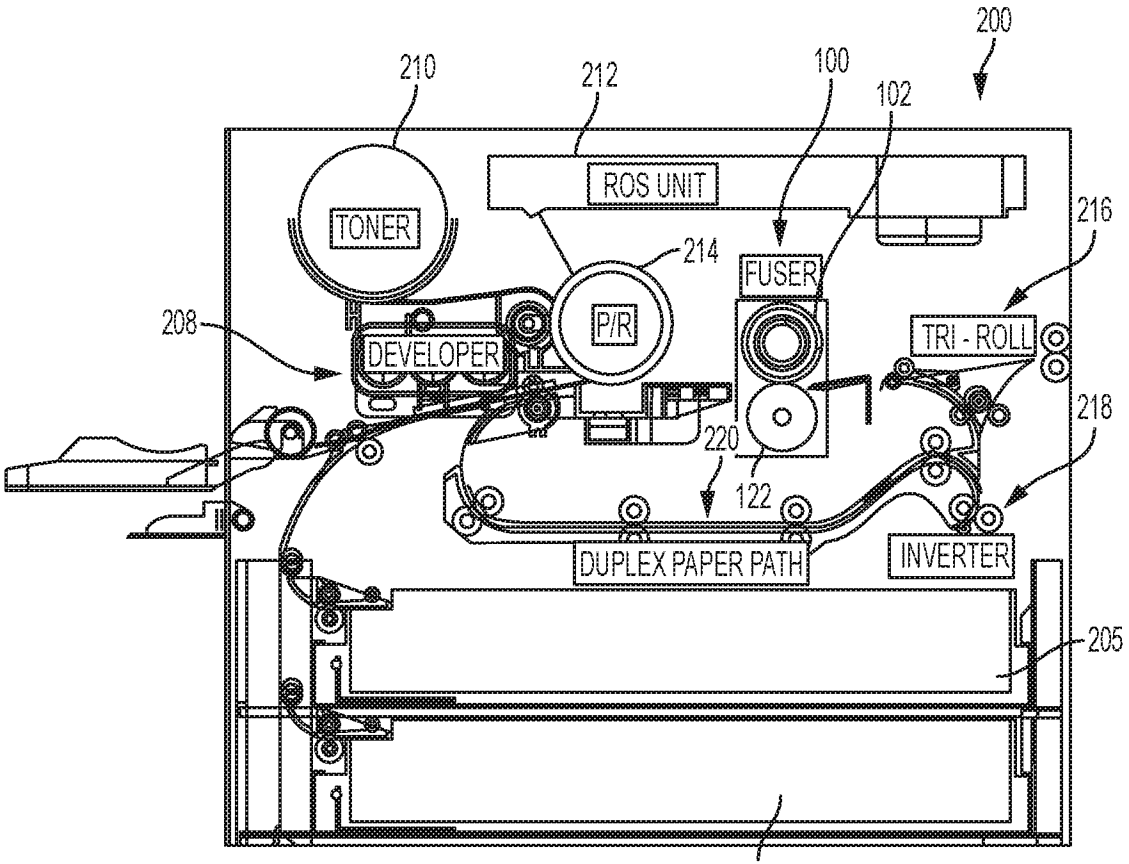
FIG. 2 is a pictorial representation of a device capable of printing including a fuser assembly with a modular power input

FIG. 2 is a pictorial representation of example device 200 capable of printing including fuser assembly 100 with a modular power input. Fuser assembly 100 is arranged for use in device 200 capable of printing. Device 200 includes electrical power system 202, which operates at voltage range V1 or voltage range V2. Voltage range V2 is different from voltage range V1. In an example embodiment, range V2 is greater than voltage range V1. When device 200 is designed to operate at voltage range V1, power inputs 110 and 114 are electrically connected to electrical power system 202. When device 200 is designed to operate at voltage range V2, power inputs 110 and 112 are electrically connected to electrical power system 202.

In an example embodiment, when device 200 is designed to operate at voltage range V1, power input 112 is free of a power connection to electrical power system 202 for the device. In an example embodiment, when device 200 is designed to operate at voltage range V2, power input 114 is free of a power connection to electrical power system 202 for the device. Heater element(s) 104 and line 116 form electrical circuit 118 powered by electrical power system 202. Heater elements 104 and 106 form electrical circuit 120 powered by electrical power system 202.

In the example of FIG. 1, device 200 operates at voltage range V1 and inputs 110 and 114 are connected to pins P1 (V1 power) and P2 (neutral) respectively, of source 202, to power circuit 118.

Fuser assembly 100 includes at least one pressure roller 122 arranged to press print media against roller(s) 102 to heat toner material on the print media and fuse the toner material to the print media. Device 200 includes: paper trays 205 and 206; developer assembly 208, toner storage 210; ROS unit 212; photoreceptor 214; tri-roll unit 216, invertor unit 218; and duplex paper path 220. Motor 123 rotates roller 102 as is known in the art.

Figure 3:
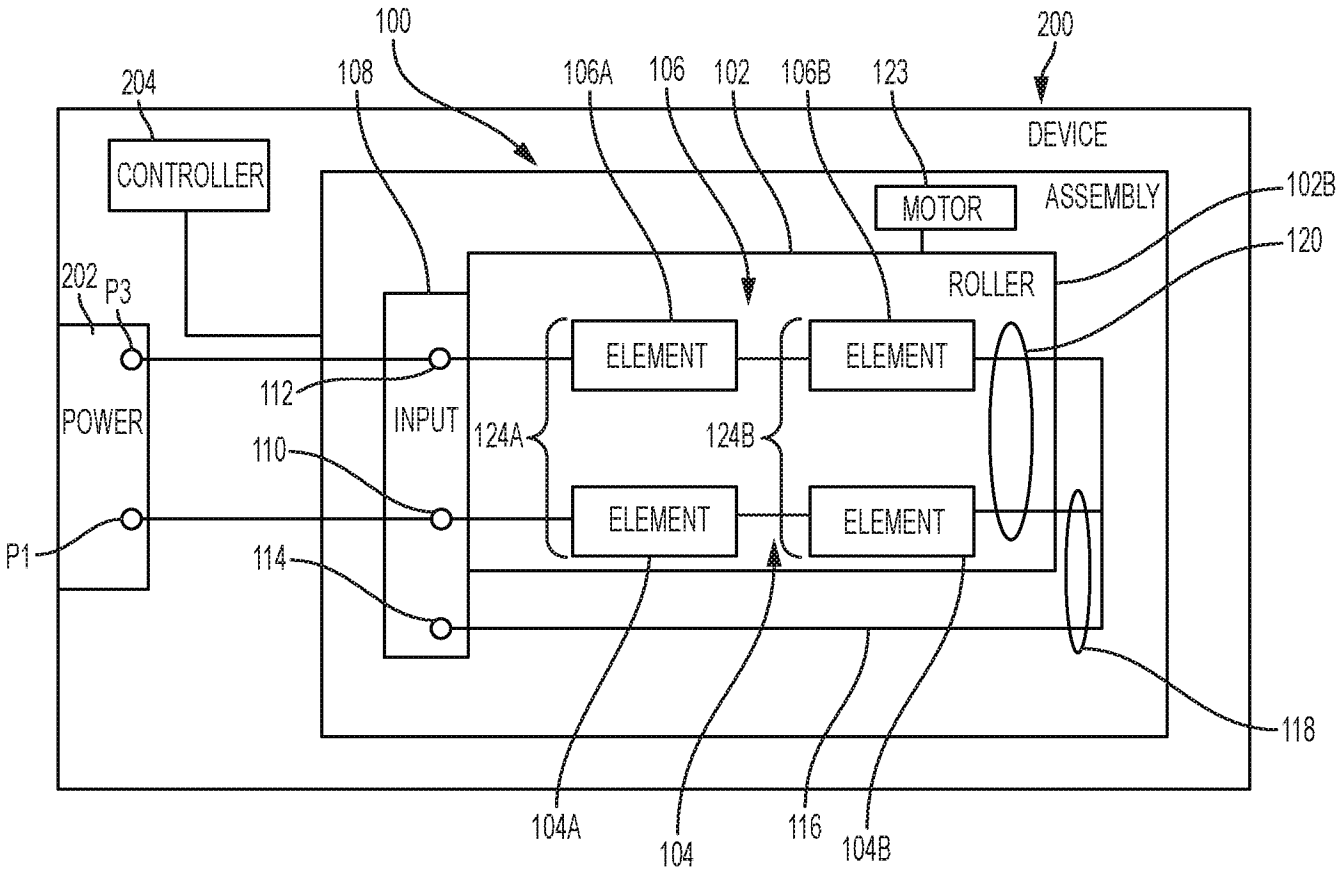
FIG. 3 is a schematic block diagram of an example device capable of printing including a fuser assembly with a modular power input and a single heater roller and multiple heater elements.

FIG. 3 is a schematic block diagram of example device 200 capable of printing including fuser assembly 100 with a modular power input and a single heater roller and multiple heater elements. In an example embodiment, assembly 100 includes only a single heater roller 102 and multiple heaters 104 and 106. In the example of FIG. 3, assembly 100 includes heater elements 104A and 104B and heater elements 106A and 106B located within the single roller 102. In an example embodiment, elements 104A and 104B are separately controllable such that both or only one or the other of elements 104A and 104B are energized. In an example embodiment, elements 104A and 106A form pair 124A and elements 104B and 106B form pair 124B. In an example embodiment, pairs 124A and 124B are separately controllable such that both or only one or the other of pairs 124A and 124B are energized. Motor 123 rotates roller 102 as is known in the art.

For media having a width no greater than one of elements 104A or 104B (voltage range V1), or pairs 124A or 124B (voltage range V2), the media can be guided between only one of energized heater elements 104A or 104B, or between only one of energized pairs 124A or 124B. Thus, only the heater elements actually aligned with the print media are energized, reducing energy consumption for device 200. For media having a width greater than either of elements 104A or 104B (voltage range V1), or pairs 124A or 124B (voltage range V2), both heater elements 104A or 104B, or both pairs 124A or 124B are energized.

In the example of FIG. 3, device 200 operates at level V2 and inputs 110 and 112 are connected to pins P1 (for example positive voltage range V1) and P3 (negative voltage range V1) respectively, of source 202 to power circuit 120. Although two heater elements 104 and 106 are shown in FIG. 3, it should be understood that other numbers of heater elements 104 and 106 can be used with a single roller 102 in assembly 100. The actual wiring configurations for heater elements 1044, 104B, 106A and 106B are not shown; however, it should be understood that parallel wiring, as known in the art, can be used to enable elements 104A and 104B to be energized separately and to enable elements 106A and 106B to be energized separately.

Figure 4:
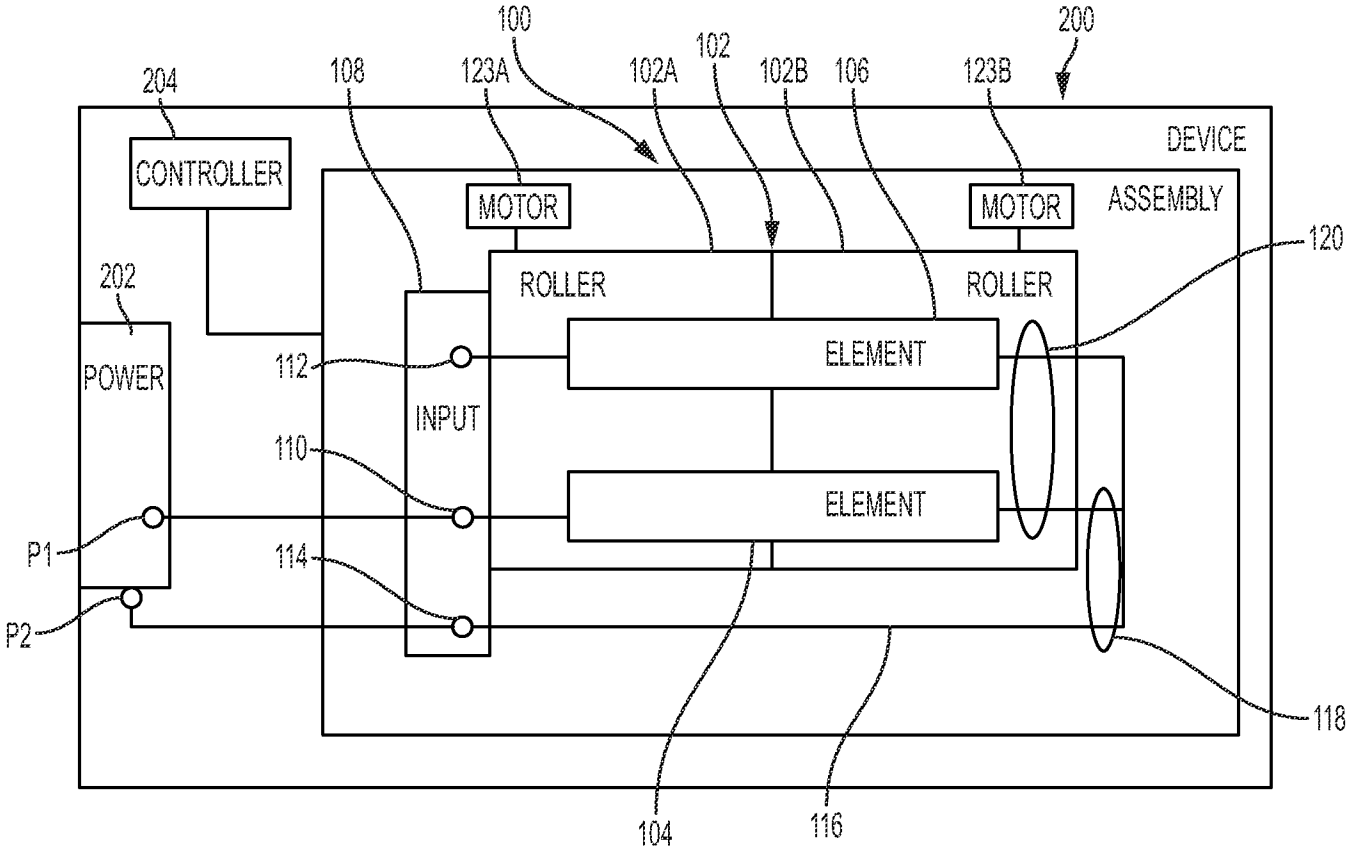
FIG. 4 is a schematic block diagram of an example device capable of printing including a fuser assembly with a modular power input and multiple heater rollers and single heater elements; and, FIG. 5 is a schematic block diagram of an example device capable of printing including a fuser assembly with a modular power input and multiple heater rollers and multiple heater elements.

FIG. 4 is a schematic block diagram of an example device 200 capable of printing including fuser assembly 100 with a modular power input and a multiple heater rollers and single heater elements. In an example embodiment, assembly 100 includes multiple rollers 102, for example rollers 102A and 102B and single heater elements 104 and 106. Elements 104 and 106 each pass through both of rollers 102A and 102B. For media having a width no greater than one of rollers 102A or 102B, the media can be guided between only one of rollers 102A and 102B and roller(s) 122 and only the one of rollers 102A or 102B is energized.

For media having a width greater than one of rollers 102A or 102B, the media can be guided between both rollers 102A and 102B and roller(s) 122 and both rollers 102A and 102B are energized. For power at voltage range V1, element 104 is energized for both width scenarios above. For power at voltage range V2, elements 104 and 106 are energized for both width scenarios. Motors 123A and 123B rotate rollers 102A and 102B, respectively, as is known in the art.

Although two rollers 102 are shown in FIG. 4, it should be understood that other numbers of rollers 102, with single elements 104 and 106, can be used in assembly 100. In FIG. 4, assembly 100 is wired for voltage range V1.

Figure 5:
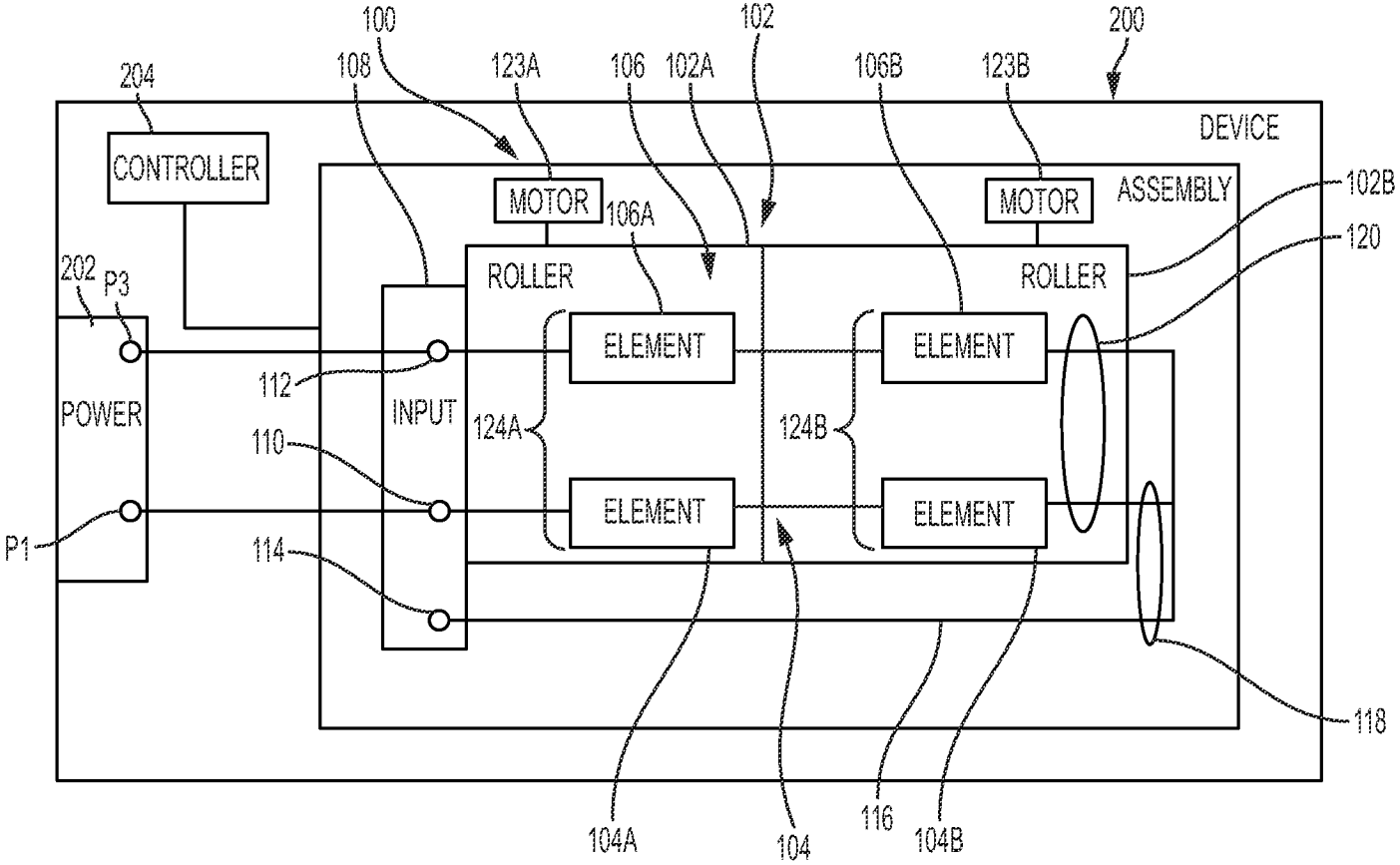

FIG. 5 is a schematic block diagram of example device 200 capable of printing including fuser assembly 100 with a modular power input and multiple heater rollers and multiple heater elements. In an example embodiment, assembly 100 includes multiple heater rollers, for example rollers 102A and 102B and multiple heater elements, for example elements 104A and 104B and elements 106A and 106B. In the example of FIG. 5, heater elements 104A and 106A are located in roller 102A and heater elements 104B and 106B are located in roller 102B. In an example embodiment, rollers 102A and 102B are separately controllable such that both or only one or the other of roller 102A or roller 102B are energized.

In an example embodiment, elements 104A and 104B are separately controllable such that both or only one or the other of elements 104A and 104B are energized. In an example embodiment, elements 104A and 106A form pair 124A and elements 104B and 106B form pair 124B. In an example embodiment, pairs 124A and 124B are separately controllable such that both or only one or the other of pairs 124A and 124B are energized. Motors 123A and 123B rotate rollers 102A and 102B, respectively, as is known in the art.

For media having a width no greater than one of rollers 102A or 102B and voltage range V1, roller 102A and element 104A are energized or roller 102B and element 104B are energized, reducing energy consumption by not energizing both heaters 104. For media having a width greater than either of rollers 102A or 102B and voltage range V1, both rollers and elements 104 are energized.

For media having a width no greater than one of rollers 102A or 102B and voltage range V2, roller 102A and pair 124A are energized or roller 102B and pair 124B are energized, reducing energy consumption by not energizing both pairs 124. For media having a width greater than either of rollers 102A or 102B, both rollers and pairs 124 are energized. Although two rollers 102 and two each elements 104 and 106 are shown in FIG. 4, it should be understood that other numbers of rollers 102 and multiple elements 104 and 106 can be used in assembly 100. In the example of FIG. 5, assembly 100 is wired for voltage range V2. The actual wiring configurations for heater elements 104A, 104B, 106A and 106B are not shown; however, it should be understood that parallel wiring, as known in the art, can be used to enable elements 104A and 104B to be energized separately and to enable elements 106A and 106B to be energized separately.

Device 200 includes controller 204 configured to execute the control functions described above. For example: controller 204 energizes motors 123, 123A and 123B as required to implement the heater roller functions described above; and controller 204 energizes heater elements 104, 104A, 104B, 106, 106A, and 106B as required to implement the heater element functions described above.

In an example embodiment, range V1 is a nominal 110 VAC at 60 Hz and range V2 is a nominal 220 AC at 50 Hz. In an example embodiment, heater elements 104 and 106 are constructed for optimal operation at 55 Hz.

The following should be viewed in light of FIGS. 1 through 5. The following describes a method of operating a device capable of printing and including a fuser assembly with at least one first and second heater elements located within at least one heater roller for the fuser assembly. Although the method is presented as a sequence of steps for clarity, no order should be inferred from the sequence unless explicitly stated. A first step energizes a power supply system for the device at a first or second voltage level. A second step: when energizing the power supply at the first voltage level, energizes, using the power supply system, the at least one first heater element, rolls a sheet of print media between the at least one heater roller and at least one pressure roller for the fuser assembly and heats, with the at least one heater roller, toner material on the sheet of print media; or, when energizing the power supply at the second voltage level, energizes, using the power supply system, the at least one first and second heater elements, rolls a sheet of print media between the at least one heater roller and at least one pressure roller for the fuser assembly and heats, with the at least one heater roller, toner material on the sheet of print media.

In an example embodiment, rolling a sheet of print media between the at least one heater roller and the at least one pressure roller includes rolling the sheet of print media between only a single heater roller and the at least one pressure roller and when energizing the power supply at the first voltage level and energizing, using the power supply system, the at least one first heater element includes energizing only a single first heater element.

In an example embodiment, rolling a sheet of print media between the at least one heater roller and the at least one pressure roller includes rolling the sheet of print media between only a single heater roller and the at least one pressure roller and when energizing the power supply at the second voltage level energizing, using the power supply system, the at least one first and second heater elements includes energizing only a single first heater element and only a single second heater element.

In an example embodiment, rolling a sheet of print media between the at least one heater roller and at least one pressure roller for the fuser assembly includes rolling the sheet of print media between only a single heater roller and at least one pressure roller and when energizing the power supply at the first voltage level and energizing, using the power supply system, the at least one first heater element includes energizing a plurality of first heater elements.

In an example embodiment, rolling a sheet of print media between the at least one heater roller and at least one pressure roller for the fuser assembly includes rolling the sheet of print media between only a single heater roller and at least one pressure roller and when energizing the power supply at the second voltage level energizing, using the power supply system, the at least one first and second heater elements includes energizing respective pluralities of first and second heater elements.

In an example embodiment, rolling a sheet of print media between the at least one heater roller and at least one pressure roller for the fuser assembly includes rolling the sheet of print media between a plurality of heater rollers and at least one pressure roller and when energizing the power supply at the first voltage level and energizing, using the power supply system, the at least one first heater element includes energizing only a single first heater element located within each heater roller included in the plurality of heater rollers.

In an example embodiment, rolling a sheet of print media between the at least one heater roller and at least one pressure roller for the fuser assembly includes rolling the sheet of print media between a plurality of heater rollers and at least one pressure roller and energizing the power supply at the second voltage level energizing, using the power supply system, the at least one first and second heater elements includes energizing only single first and second heater elements located within each heater roller included in the plurality of heater rollers.

In an example embodiment, rolling a sheet of print media between the at least one heater roller and at least one pressure roller for the fuser assembly includes rolling the sheet of print media between a plurality of heater rollers and at least one pressure roller and when energizing the power supply at the first voltage level and energizing, using the power supply system, the at least one first heater element includes energizing a plurality of first heater elements, each first heater element located in a respective heater roller.

In an example embodiment, rolling a sheet of print media between the at least one heater roller and at least one pressure roller for the fuser assembly includes rolling the sheet of print media between a plurality of heater rollers and at least one pressure roller and energizing the power supply at the second voltage level energizing, using the power supply system, the at least one first and second heater elements includes energizing: a plurality of first heater elements, each first heater element located in a respective heater roller; and a plurality of second heater elements, each second heater element located in a respective heater roller.

Advantageously, assembly 100 solves the problems noted above by providing a modular fuser assembly usable with printers configurable to operate at multiple voltage levels. Thus, a parts supplier for or a fabricator of a printer configurable to operate at multiple voltage levels does not need to stock or obtain different fuser assemblies according to the operating voltage of a printer. Further, assembly 100 does not require modification of existing printer designs. That is, assembly 100 is designed to fit within spaced provided for the fuser in existing configurations in and uses available pins or power connections in the existing power supply for the printer.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A fuser assembly for a device capable of printing, comprising:
- at least one heater roller;
- at least one first heater element located within the at least one heater roller;
- at least one second heater element located within the at least one heater roller;
- an electrical line;
- a power input component including:
  - a first power input for the at least one first heater element;
  - a second power input for the at least one second heater element; and,
  - a third power input for the electrical line;
- a first electrical circuit designed to operate at a first voltage range and including the first power input of the at least one first heater element and the third power input for the electrical line and operatively arranged to energize the at least one first heater element and not energize the at least one second heater element; and,
- a second electrical circuit:
  - designed to operate at a second voltage range, different from the first voltage range; and,
  - including the first power input for the at least one first heater element and the second power input for the second heater element and arranged to energize the at least one first heater element and the at least one second heater element,
- wherein the second voltage range is greater than the first voltage range.

2. The fuser assembly of claim 1, wherein:
- when the device is designed to operate at the first voltage range, the first and third power inputs are arranged to be connected to an electrical power system for the device; and,
- when the device is designed to operate at the second voltage range, the first and second power inputs are arranged to be connected to the electrical power system for the device.

3. The fuser assembly of claim 1, wherein each of the at least one first and second heater elements is designed to operate at the first voltage range.

4. The fuser assembly of claim 1, further comprising:
- at least one pressure roller paired with the at least one heater roller and arranged to press print media against the at least one heater roller.

5. The fuser assembly of claim 1, wherein:
- the at least one heater roller includes a single heater roller;
- the at least one first heater element includes only a single first heater element; and,
- the at least one second heater element includes only a single second heater element.

6. The fuser assembly of claim 1, wherein:
- the at least one heater roller includes only a single heater roller;
- the at least one first heater element includes a plurality of first heater elements; and,
- the at least one second heater element includes a plurality of second heater elements.

7. The fuser assembly of claim 6, further comprising:
- a plurality of pairs of first and second heater elements, wherein:
  - each pair is located in a different portion of the single heater roller; and,
  - each pair is separately controllable.

8. The fuser assembly of claim 1, wherein:
- the at least one heater roller includes a plurality of heater rollers;
- the at least one first heater element includes only a single first heater element; and,
- the at least one second heater element includes only a single second heater element.

9. The fuser assembly of claim 1, wherein:
- the at least one heater roller includes a plurality of heater rollers;
- the at least one first heater element includes a plurality of first heater elements; and,
- the at least one second heater element includes a plurality of second heater elements.

10. The fuser assembly of claim 9, further comprising:
- a plurality of pairs of first and second heater elements, wherein:
  - each pair is located in a respective separate heater roller; and,
  - each pair is separately controllable.

11. A device capable of printing, comprising:
- a power supply system; and,
- a fuser assembly including:
  - at least one heater roller;
  - at least one first heater element configured to operate at a first voltage range and located within the at least one heater roller;

at least one second heater element:

configured to operate at a second voltage range different from the first voltage range; and, located within the at least one heater roller;

an electrical line; and, a power input component including:

a first power input for the at least one first heater element;

a second power input for the at least one second heater element; and, a third power input for the electrical line, wherein:

when the device is designed to operate at the first voltage range, the first and third power inputs are connected to the power supply system for the device and are arranged to energize the at least one first heater element and not the at least one second heater element; and, when the device is designed to operate at the second voltage range, the first and second power inputs are connected to the power supply system for the device and arranged to energize the at least one first heater element and the at least one second heater element;

wherein the second voltage range is greater than the first voltage range.

12. The device of claim 11, wherein each of the at least one first and second heater elements is designed to operate at the first voltage range.

13. The device of claim 11, further comprising:

at least one pressure roller paired with the at least one heater roller and arranged to press print media against the at least one heater roller.

14. The fuser assembly of claim 11, wherein:

the at least one heater roller includes a single heater roller;

the at least one first heater element includes only a single first heater element; and, the at least one second heater element includes only a single second heater element.

15. The device of claim 11, wherein:

the at least one heater roller includes only a single heater roller;

the at least one first heater element includes a plurality of first heater elements; and, the at least one second heater element includes a plurality of second heater elements.

16. The device of claim 11, wherein:

the at least one heater roller includes a plurality of heater rollers;

the at least one first heater element includes only a single first heater element; and, the at least one second heater element includes only a single second heater element.

17. The device of claim 11, wherein:

the at least one heater roller includes a plurality of heater rollers;

the at least one first heater element includes a plurality of first heater elements; and, the at least one second heater element includes a plurality of second heater elements.

18. A method of operating a device capable of printing and including a fuser assembly with at least one first and second heater elements located within at least one heater roller for the fuser assembly, the method comprising:

energizing a power supply system for the device at a first or second voltage level; and, when energizing the power supply at the first voltage level:

energizing, using a first power input and a second power input of the power supply system, the at least one first heater element and not the at least one second heater element;

rolling a sheet of print media between the at least one heater roller and at least one pressure roller for the fuser assembly; and, heating, with the at least one heater roller, toner material on the sheet of print media; and, when energizing the power supply at the second voltage level:

energizing, using the first power input and a third power input of the power supply system, the at least one first and second heater elements;

rolling a sheet of print media between the at least one heater roller and at least one pressure roller for the fuser assembly; and, heating, with the at least one heater roller, toner material on the sheet of print media;

wherein the second voltage level is greater than the first voltage level.

19. The method of claim 18, wherein rolling a sheet of print media between the at least one heater roller and at least one pressure roller for the fuser assembly includes rolling the sheet of print media between only a single heater roller and the at least one pressure roller; and, wherein:

when energizing the power supply at the first voltage level and energizing, using the power supply system, the at least one first heater element includes energizing only a single first heater element; and, when energizing the power supply at the second voltage level energizing, using the power supply system, the at least one first and second heater elements includes energizing only a single first heater element and only a single second heater element.

20. The method of claim 18, wherein rolling a sheet of print media between the at least one heater roller and at least one pressure roller for the fuser assembly includes rolling the sheet of print media between only a single heater roller and at least one pressure roller; and, wherein:

when energizing the power supply at the first voltage level and energizing, using the power supply system, the at least one first heater element includes energizing a plurality of first heater elements; or, when energizing the power supply at the second voltage level energizing, using the power supply system, the at least one first and second heater elements includes energizing respective pluralities of first and second heater elements.

21. The method of claim 18, wherein rolling a sheet of print media between the at least one heater roller and at least one pressure roller for the fuser assembly includes rolling the sheet of print media between a plurality of heater rollers and at least one pressure roller; and, wherein:

when energizing the power supply at the first voltage level and energizing, using the power supply system, the at least one first heater element includes energizing only a single first heater element located within each heater roller included in the plurality of heater rollers; or, when energizing the power supply at the second voltage level energizing, using the power supply system, the at least one first and second heater elements includes energizing only a single first heater element and only a single second heater element located within each heater roller included in the plurality of heater rollers.

22. The method of claim 18, wherein rolling a sheet of print media between the at least one heater roller and at least one pressure roller for the fuser assembly includes rolling the sheet of print media between a plurality of heater rollers and at least one pressure roller; and, wherein:

when energizing the power supply at the first voltage level and energizing, using the power supply system, the at least one first heater element includes energizing a plurality of first heater elements, each first heater element located in a respective heater roller; or, when energizing the power supply at the second voltage level energizing, using the power supply system, the at least one first and second heater elements includes energizing:

a plurality of first heater elements, each first heater element located in a respective heater roller; and, a plurality of second heater elements, each second heater element located in a respective heater roller.

* * * * *